US005857026A

United States Patent [19]

Scheiber

[11] Patent Number: 5,857,026

[45] Date of Patent: Jan. 5, 1999

[54] SPACE-MAPPING SOUND SYSTEM

[76] Inventor: Peter Scheiber, 6776 Kerr Creek Rd., Bloomington, Ind. 47408

[21] Appl. No.: 824,150

[22] Filed: Mar. 25, 1997

Related U.S. Application Data

[60] Provisional application No. 60/014,099 Mar. 26, 1996.

[51] Int. Cl. [6] ..... H04S 3/00

[52] U.S. Cl. ..... 381/23; 381/22; 381/18

[58] Field of Search ..... 381/18, 19, 20, 381/21, 22, 23

[56] References Cited

U.S. PATENT DOCUMENTS

| | | | |
|---|---|---|---|
| 3,632,886 | 1/1972 | Scheiber | 381/23 |
| 3,746,792 | 7/1973 | Scheiber | 381/23 |
| 3,959,590 | 5/1976 | Scheiber | 381/22 |
| 4,891,839 | 1/1990 | Scheiber | 381/22 |

*Primary Examiner*—Forester W. Isen

*Attorney, Agent, or Firm*—Woodard, Emhardt, Naughton, Moriarty & McNett

[57] ABSTRACT

A sound system is disclosed which, in common with earlier phase-amplitude multichannel "matrix" encode-decode systems, conveys or stores audio programs having multidirectional sound-source localization in a pair of audio-bandwidth channels, whether analog or digital. In the present invention, representation of a vertical, height dimension is added by mapping the "phase-amplitude sphere" representing signal separation onto a spatial hemisphere and by introducing to the parameters of phase difference and amplitude ratio a third parameter, decorrelation. Non-complementary matrices are used for encoding and decoding to provide improved separation between decoded signals. A radius-scaling function facilitates encoding of sound source locations outside, as well as within, the boundaries of the audience space defined by the peripheral and overhead loudspeaker locations.

4 Claims, 14 Drawing Sheets

Encoded Phantom Center Levels

Encoded Cf

Encoded Lf

Encoded Cl

Encoded Lb

Encoded Cb

Encoded Cf

Encoded Lf

Encoded Lb

Encoded Cb

SPACE-MAPPING SOUND SYSTEM

TECHNICAL FIELD OF THE INVENTION

This application claims benefit of USC Provisional Appln. No. 60/014,099 filed Mar. 26, 1996.

The present invention generally relates to audio storage and reproduction systems and, more particularly, to a three dimensional sound system.

BACKGROUND OF THE INVENTION

FIG. 1 illustrates a prior art mathematical model for channel separation in "matrix" multichannel encode-decode systems as first described by the present inventor in "Analyzing Phase-Amplitude Matrices", *Journal of the Audio Engineering Society,* Vol. 19, No. 10, p. 835 (November 1971). This model is referred to as "Scheiber's Sphere" in "The Subjective Performance of Various Quadraphonic Matrix Systems", *Report RD* 1974/29 (1974, British Broadcasting Corporation, Research Department). In this model, two times the arc tangent of the amplitude ratio with which a signal is applied to/recovered from a pair of transmission or storage channels (respective "A" and "B" or "$L_T$" and "$R_T$") determines the apparent angular position, $\alpha$, of a sound source in a horizontal "amplitude plane." The phase difference with which the signal is applied to/recovered from the pair of channels comprises the apparent angular position, $\beta$, of the sound source in a vertical "phase plane." Decoded separation between encoded/decoded signals, or "channel separation," is a function of spherical angular separation between the spherical $\alpha,\beta$ coordinates of decoding and those of encoding, becoming infinite for any encode/decode pair of signals having 180° spherical angular separation (decoding coordinates diametrically opposed to encoding coordinates). The above-referenced article "Analyzing Phase-Amplitude Matrices" sets forth this theory more fully, and is incorporated herein by reference.

SUMMARY OF THE INVENTION

Figure 1:
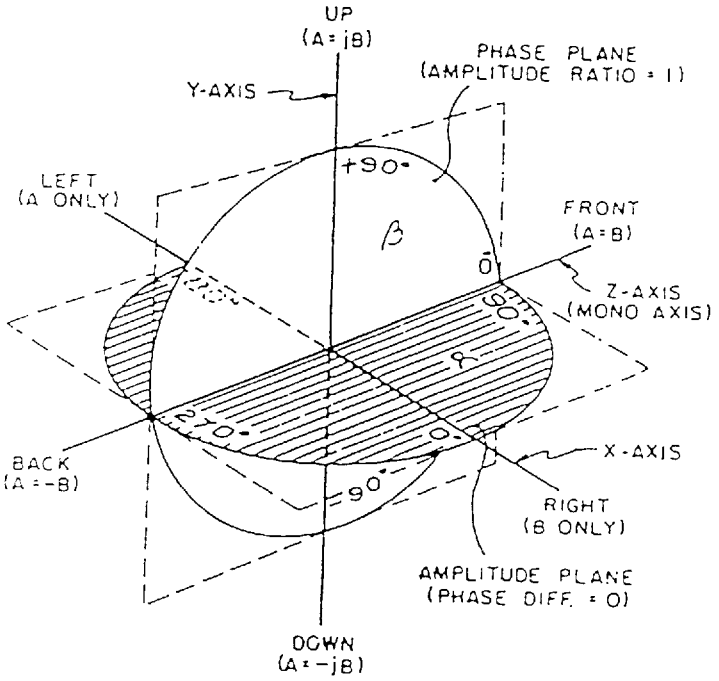
FIG. 1 is a prior art schematic representation of signal separation obtained through phase-amplitude encoding and decoding in two audio-bandwidth channels.

A sound system is disclosed which, in common with earlier phase-amplitude multichannel "matrix" encode-decode systems, conveys or stores audio programs having multidirectional sound-source localization in a pair of audio-bandwidth channels, whether analog or digital. In the present invention, representation of a vertical, height dimension is added by mapping the "phase-amplitude sphere" representing signal separation onto a spatial hemisphere and by introducing to the parameters of phase difference and amplitude ratio a third parameter, decorrelation. Non-complementary matrices are used for encoding and decoding to provide improved separation between decoded signals. A radius-scaling function facilitates encoding of sound source locations outside, as well as within, the boundaries of the audience space defined by the peripheral and overhead loudspeaker locations.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

It is essential to note that the $\alpha,\beta$ angular coordinates determine electrical separation in encoding and decoding systems, and may, but need not, correspond to actual spatial azimuth and elevation coordinates at which signals are designated to be located in encoding or decoding.

Figure 2:
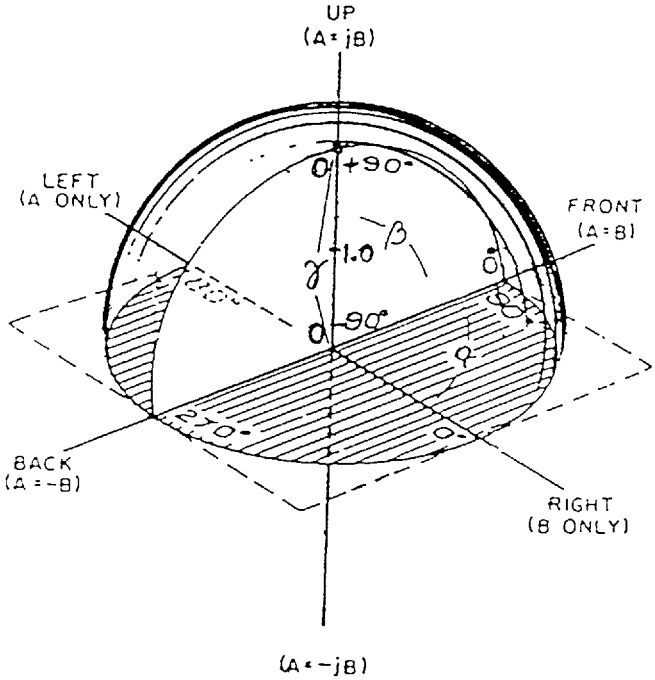
FIG. 2 is a schematic representation of sound-source localization on and within a hemisphere bounded by a plane and a dome.

FIG. 2 is a representation of actual, spatial, designated sound-source location on and within a hemisphere bounded on the bottom by a plane, and on the top, by a "dome." This is derived by mapping the $\alpha,\beta$ spherical coordinates representing electrical channel separation onto a hemisphere representing actual, physical sound-source location by the combination of (1) flattening the bottom hemisphere of the above-described $\alpha,\beta$ sphere to coincide with the physical "audience plane" on which sounds are to be localized, with the reference audience or listener position at the center of the plane, and (2) retaining the top hemisphere of the $\alpha,\beta$ sphere substantially unaltered so that $\alpha$ and $\beta$ correspond to respective spatial azimuth and elevation angles at which sounds are to be localized around and above the audience, provided that the elevation angle is measured around a left-right axis defined by $\alpha=0°,180°$.

The mapping of the $\alpha,\beta$ sphere, or "phase-amplitude sphere" representing electrical separation onto a flat-bottomed hemisphere representing spatial position results in the ability to encode and decode sound source location on the audience plane with variable azimuth and radius (distance) with respect to the reference position at the center of the plane in combination with encoding and decoding sound source direction overhead with constant radius but with variable azimuth and elevation, again with reference to the center of the audience plane. Therefore, $\alpha$ and $\beta$ can be used to map an apparent sound source location onto a surface of the hemisphere, but not within it.

To provide the ability to encode and decode sound-source location within the volume of the hemisphere, a third parameter, $\gamma$, is added to $\alpha$ and $\beta$ which represent functions of respective amplitude ratio and phase difference in the transmission or storage channels A and B or $L_T$ and $R_T$. $\gamma$ consists of decorrelation in the transmission or storage channels. In contrast with $\alpha$ and $\beta$, which represent angles and apply to both encoding and decoding, decorrelation $\gamma$ represents height and is used in encoding only. Decorrelation is designated to reach its maximum value (nominally unity) at the midpoint of the vertical, central axis of the hemispherical representation of the audience space, and its minimum value of zero at both ends of this axis. It may be implemented by applying the signal to be encoded to the transmission/storage channels through known prior art room-reverberation-simulating circuits, or through other circuits which provide varying amounts of differential phase shift in the transmission/storage channels during the integration period of decoder "logic" direction sensing (typically more than a millisecond and less than a second), or with change in frequency, such as all-pass filters. Examples of circuits which provide varying amounts of differential phase shift during the integration period of the logic include (a) A known differential all-pass phase-shifter network comprising a nominal $\psi_1$ section and a nominal $\psi_2$ section inserted in the respective signal paths connecting the input signal desired to be placed within the volume of the hemisphere to the respective $L_T$ and $R_T$ transmission/storage channels, the magnitude of phase shift of one $\psi$ section modulated on a time-varying basis, or (b) As above, but with the magnitude of phase shift of both $\psi$ sections complementarily so modulated. Examples of circuits which provide varying amounts of differential phase shift with frequency include (c) An all-pass phase shifter $\psi$ section whose output phase shift varies with frequency as referenced to its input, inserted in the signal path connecting the input signal desired to be placed within the volume of the hemisphere to either the $L_T$ or the $R_T$ transmission/storage channel; (d) A known time-delay circuit providing delay of roughly one or a few milliseconds inserted, as above, in the signal path connecting the input signal desired to be placed within the volume of the hemisphere to either the $L_T$ or the $R_T$ transmission/storage channel; (e) A known synthetic reverberation circuit incorporating multiple time delays employed in the same manner as the above-mentioned time-delay circuit; (e) Differing time-delay or synthetic reverberation circuits inserted in the respective signal paths connecting the input signal desired to be placed within the volume of the hemisphere to the respective $L_T$ and $R_T$ transmission/storage channels.

Phase shift varying with both time and frequency may be employed by (g) Applying the time-varying modulation described with reference to above examples a and b to the delays incorporated in the time-delay or reverberation circuits described with reference to above examples c–f.

Phase shift varying with time during the integration period of decoder logic direction sensing acts to prevent sensing of any specific encoded direction, effectively disabling logic separation enhancement. Phase shift varying with frequency acts to encode the different spectral components of the input signal desired to be placed within the volume of the hemisphere with different relative phases in $L_T$ and $R_T$, likewise preventing sensing of any specific encoded direction and effectively disabling decoder logic separation enhancement. Either way, such input signal is reproduced by all loudspeakers bounding the listener plane in addition to the overhead loudspeaker ($C_U$). This reproduction by all peripheral loudspeakers represents, according to usual convention for multichannel reproduction, an overall center location in the space bounded by the loudspeakers for such encoder input signal.

While decorrelation could be applied to an encode-decode system directly mapping the $\alpha,\beta$ sphere onto a spatial sphere, thus permitting localization at the center of the $\alpha,\beta$ sphere corresponding to the center of the audience plane, use with the present system mapping the $\alpha,\beta$ sphere onto a spatial hemisphere has the following practical advantages: (1) Sounds encoded at the center of the audience plane (nominal zero radius) are inherently canceled in and absent from a decoded overhead or Center Up ($C_U$) output channel, and (2) All sounds encoded at any desired location (azimuth and radius) on the audience plane may be fully canceled in the decoded overhead output by "logic" separation enhancement used in decoding.

Noting the above statement that the $\alpha,\beta$ spherical angular coordinates determining electrical separation in encoding and decoding may, but need not, correspond to actual spatial azimuth and elevation coordinates at which signals are designated to be located in encoding or decoding, prior-art matrix multichannel encode-decode systems have deviated from such correspondence in order to achieve spatial distribution of the available "channel separation" that was deemed desirable by their designers. For example, the designers of the market-leading "quadraphonic" system of the 1970s and the designers of the market-leading cinema/video system of the 1980s and 1990s both elected (though without reference to the phase-amplitude sphere) to provide nominally infinite "channel separation" between the pair of encoder inputs/decoder outputs ("channels") designated for reproduction at Left Front and Right Front locations with reference to the center of the audience.

This approach, however, results in the situation that, when separate, unrelated sounds of equal intensity are simultaneously encoded at both of these front locations, the signals in the transmission/storage channels are uncorrelated, resulting in failure to provide the decoder logic with information as to the "frontness" of the encoded signals. As a result, there is a severe crosstalk between the front and rear outputs. A preferable approach, used in the present invention, is to encode the signals such that designated azimuthal direction directly corresponds to spherical angular position ($\alpha$), and to make the decoding matrix non-complementary to the encoding matrix to yield the desired distribution of available separation. This is discussed hereinbelow with reference to FIGS. 4, 5 and 6.

Preferred embodiment three-dimensional encoders may employ decorrelation to permit encoding of sounds within a spatial volume. They may have inputs corresponding to fixed, predetermined sound-source locations, or may have inputs that are individually pannable to any desired location in three-dimensional (left/right, front/back, up/down) space in response to control signals representing three-dimensional location. Radius scaling, or scaling of encoded sound-source apparent distance from the center of the audience plane, may be used to permit scaling of the apparent dimensions of the encoded/decoded, or virtual, sound environment (1) to coincide with the dimensions of the physical audience space as defined by the locations of the peripheral and overhead playback loudspeakers, or (2) to comprise any desired multiple (or fraction) of the audience-space dimensions.

Preferred embodiment decoders may provide outputs for application to a combination of peripheral, audience-plane loudspeakers and overhead loudspeaker(s) as suited to reproduce localization of encoded sounds in the apparent locations designated for these sounds in the encoding process. They may also employ a matrix non-complementary to the encode matrix in order to achieve desirable distribution of separation among the decoded outputs.

Implementation of encoders and decoders may be in analog or digital hardware, or, if adequate processing speed is available, in software, provided that the essential operations are performed.

FIGS. 3*a–e* are schematic block diagrams of encoders having inputs corresponding to fixed, predetermined sound-source locations. Azimuthal direction in space designated for decoding and reproduction of each input, as referenced to an axis extending rightward from the center point of an intended playback space with a forward-facing audience, corresponds directly to the orientation of its encoding coordinate $\alpha$, which is measured from the right, amplitude-plane axis in the phase-amplitude sphere, as illustrated in FIG. 1. For example, a Left Front encoder input signal is encoded at 135° in terms of both spatial direction and its encoding coordinate $\alpha$. Since designated spatial azimuth and $\alpha$ coincide one-on-one, electrical separation between pairs of encoded inputs increases with spatial separation, with electrical separation between inputs nominally 180° apart in space ($L_F$, $R_B$; $R_F$, $L_B$; $C_F$, $C_B$) being infinite for all inputs regardless of their specific designated orientations—a psychoacoustically desirable situation. Such encoders may be referred to as "rotationally symmetrical." Such rotational symmetry in encoding further assures that correct information regarding mean encoded direction is provided to the decoder "logic" direction sensing circuitry when a plurality of separate, uncorrelated sound signals is applied to any combination of encoder inputs. This contrasts with the situation for prior-art systems employing complementary, but non-rotationally-symmetrical encode and decode matrices in the interest of maximizing front separation, such as the market-leading cinema/video system. In such systems, application of separate, equal, uncorrelated signals to the pair of encoder inputs intended for reproduction at the front of the audience space (front stereo) results in mutually uncorrelated transmission-channel signals $L_T$ and $R_T$, providing no information to the decoder direction sensing circuitry regarding the "frontness" of the program. With rotationally symmetrical encoding, use of a decoding matrix that is non-complementary to the rotationally-symmetrical encoding matrix may accomplish the purpose of maximizing front separation, as will be described in greater detail hereinbelow with reference to FIGS. 4 through 6.

Figure 3A:
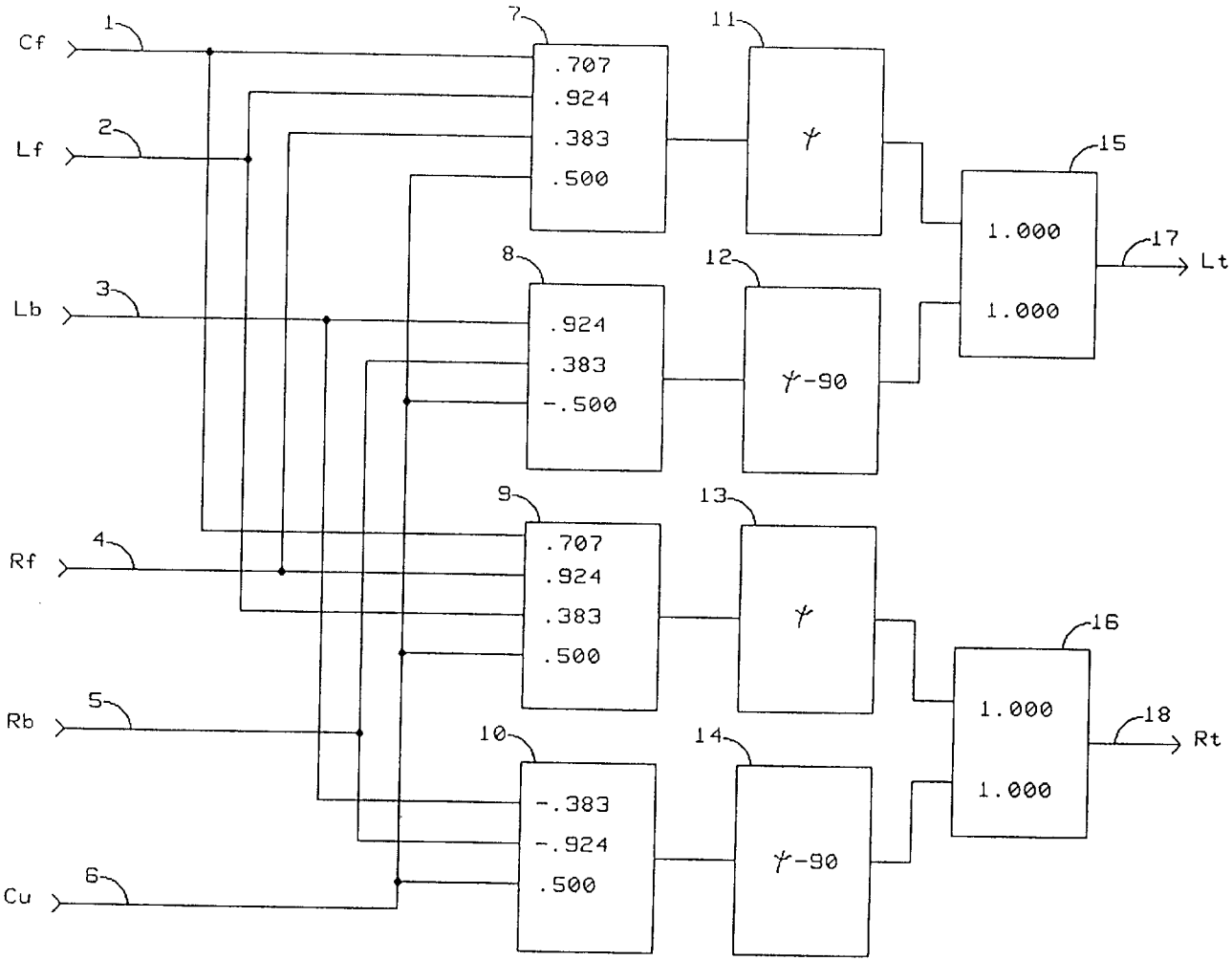
FIG. 3*a* is a schematic block diagram of a hemispherical encoder providing five audience-plane inputs and one overhead input.

FIG. 3*a* is a schematic block diagram of a three-dimensional encoder having five audience-plane inputs Center Front ($C_F$) 1, Left Front ($L_F$) 2, Left Back ($L_B$) 3, Right Front ($R_F$) 4, Right Back ($R_B$) 5 and one overhead input Center Up ($C_U$) 6. The inputs 1–6 are applied to four linear summers 7–10 having input signs and coefficients as shown. These coefficients of the linear summers are selected to meet two criteria.

The first criterion is that of encoding each input signal at the $\alpha,\beta$ Scheiber-sphere location corresponding to the signal's designated spatial location such as $C_F$, $L_F$, $L_B$, $R_F$, $R_B$, $C_U$. This is determined according to the following rules governing amplitude ratio and phase difference in transmission/storage channels $L_T$ and $R_T$: For each input, the amplitude ratio with which the signal is applied to $L_T$ and $R_T$ is $|L_T|/|R_T|=\tan\alpha$, where $\alpha$ is one-half the input's designated azimuth angle measured counterclockwise from "straight right" (Center Right, $C_R$). $L_T$ comprises the square root of the sum of the squares of the nominal zero-degree signal passing through phase shifter 11 and the nominal ninety-degree signal passing through phase shifter 12; $R_T$ comprises the square root of the sum of the squares of the nominal zero-degree signal passing through phase shifter 13 and the nominal ninety-degree signal passing through phase shifter 14. For each input, the phase difference $\beta$ with which the signal is applied to $L_T$ and $R_T$ corresponds directly to the signal's designated elevation angle measured around a left-right (Center Left-Center Right, $C_L$-$C_R$) axis.

It may be noted that $\beta$ does not represent absolute phase in $L_T$ and $R_T$, but difference between the phases with which an input signal to be encoded is applied to $L_T$ and $R_T$. For example, $L_B$ can be encoded as $L_T=0.924\ L_B$, $R_T=-0.383\ L_B$, resulting in correct encoding of its spherical direction of $\alpha=225°$, $\beta=0°$. Reference phase for the $L_B$ input (or any other encoder input) can be changed by any amount without affecting phase difference $\beta$ in $L_T$ and $R_T$; for example, we may also encode $L_B$ as $L_T=-0.924\ jL_B$, $R_T=0.383\ jR_B$ and the encoded spherical direction remains $\alpha=225°$, $\beta=0°$. (With reference to FIG. 3*a*, phase-shifter sections 11 and 13 are considered to have no effect on signal coefficients, and sections 12 and 14 are considered to apply the operator −j.)

The second criterion for selecting coefficients for linear summers 7–10 is that reference phase for each input is selected to provide desired $\alpha,\beta$ spherical coordinates for encoded "phantom center" locations obtained by applying an input signal desired to be encoded at a location between the designated directions of a pair of inputs to both inputs simultaneously. In the interest of optimal encoding of Center Back ($C_B$) location, obtained by applying the desired $C_B$ signal equally to the encoder $L_B$ and $R_B$ inputs, linear summer coefficients are selected so that $L_B$ is encoded as $L_T=-0.924\ jL_B$, $R_T=0.383\ jL_B$ and $R_B$ is encoded as $L_T=-0.383\ jL_B$, $R_T=0.924\ jL_B$. Linear summer coefficients, and resulting reference phases for inputs 1–6 are further selected to provide correct encoding ($L_T=-jR_T$) of an overall Center location on the audience plane (bounded by the $C_F$, $L_F$, $L_B$, $R_F$, $R_B$ loudspeakers) when a desired Center (C) signal is applied equally to the encoder $L_F$, $L_B$, $R_F$, $R_B$ inputs. (In FIG. 3*c*, the reference phases for the $L_B$ and $R_B$ inputs are altered without affecting the encoding of the $L_B$ or $R_B$ directions so as to obtain a phantom $C_B$ location more compatible with monophonic playback.)

The outputs of the summers 7–10 are applied to differential all-pass phase shifters 11–14, with 11 and 13 providing reference zero-degree phase and 12 and 14 providing ninety-degree phase with reference to the reference zero-degree phase throughout the audio-frequency band. The outputs of phase shifters 11 and 12 are applied to a linear output summer 15, while the outputs of phase shifters 13 and 14 are applied to a linear output summer 16. The output summers 15 and 16 are coupled to respective transmission/storage-channel outputs $L_T$ 17 and $R_T$ 18.

Relative phase references for the various inputs (as distinguished from β, the relative phase of an encoded signal in $L_T$ and $R_T$) have been selected so as to provide correct intuitive encoding of Center Back ($C_B$) and Center-of-the-audience-plane (C) locations. Center Back ($C_B$) location is obtained by the intuitive method of applying the signal to be encoded at that location equally to the $L_B$ and $R_B$ inputs resulting in $L_T$ and $R_T$ being equal in amplitude and 180° out of phase with each other. When this is done by a conventional pan pot employing coefficients of 0.707, the encoded $C_B$ signal is 2.3 dB "hot" in terms of transmission-channel total power ($L_T^2+R_T^2$) with reference to a signal applied with unity coefficient to any single input. Center of the audience plane (C) is encoded by applying the signal to be encoded at C to all four "corner" inputs, $L_F$, $R_F$, $L_B$, $R_B$ resulting in $L_T$ and $R_T$ being equal in amplitude with $R_T$ leading $L_T$ by 90°. This is the intuitive method for recording engineers thinking in terms of "discrete" multichannel sound systems. Reproduction of such encoded C is obtained, in decoders such as those of FIGS. 5*a* and 5*b*, through all peripheral, audience-plane outputs, the C signal not appearing in the overhead ($C_U$) output. (Reproduction of center-of-the-room location is conventionally represented by reproduction through all peripheral loudspeakers in multichannel sound systems, whether matrixed or "discrete.") When the desired C signal is applied to the "corner" inputs with coefficients of 0.5, the encoded C signal is 2.3 dB "hot." This is reasonable, since C is nominally located exactly at the position of the listener (center of the audience plane).

The encoder of FIG. 3*a* provides a separate $C_F$ input, consistent with multichannel sound systems designed for use in conjunction with a picture screen. For less critical uses, this input may be omitted, and a signal to be encoded at $C_F$ may be applied equally to the $L_F$ and $R_F$ inputs. If coefficients of 0.707 are used for this purpose, the encoded $C_F$ signal will be 2.3 dB hot with reference to a signal applied to any single input.

If conventional logic separation enhancement is used to decode a program encoded with any of the encoders of FIGS. 3*a–e*, the dynamic enhancement would cancel the encoded $C_U$ signal out of the audience-plane outputs, and the signals from the encoded peripheral audience-plane signals would be canceled out of decoded overhead output $C_U'$, but the encoded C signal would not need to be canceled out of the overhead output $C_U'$.

Figure 3B:
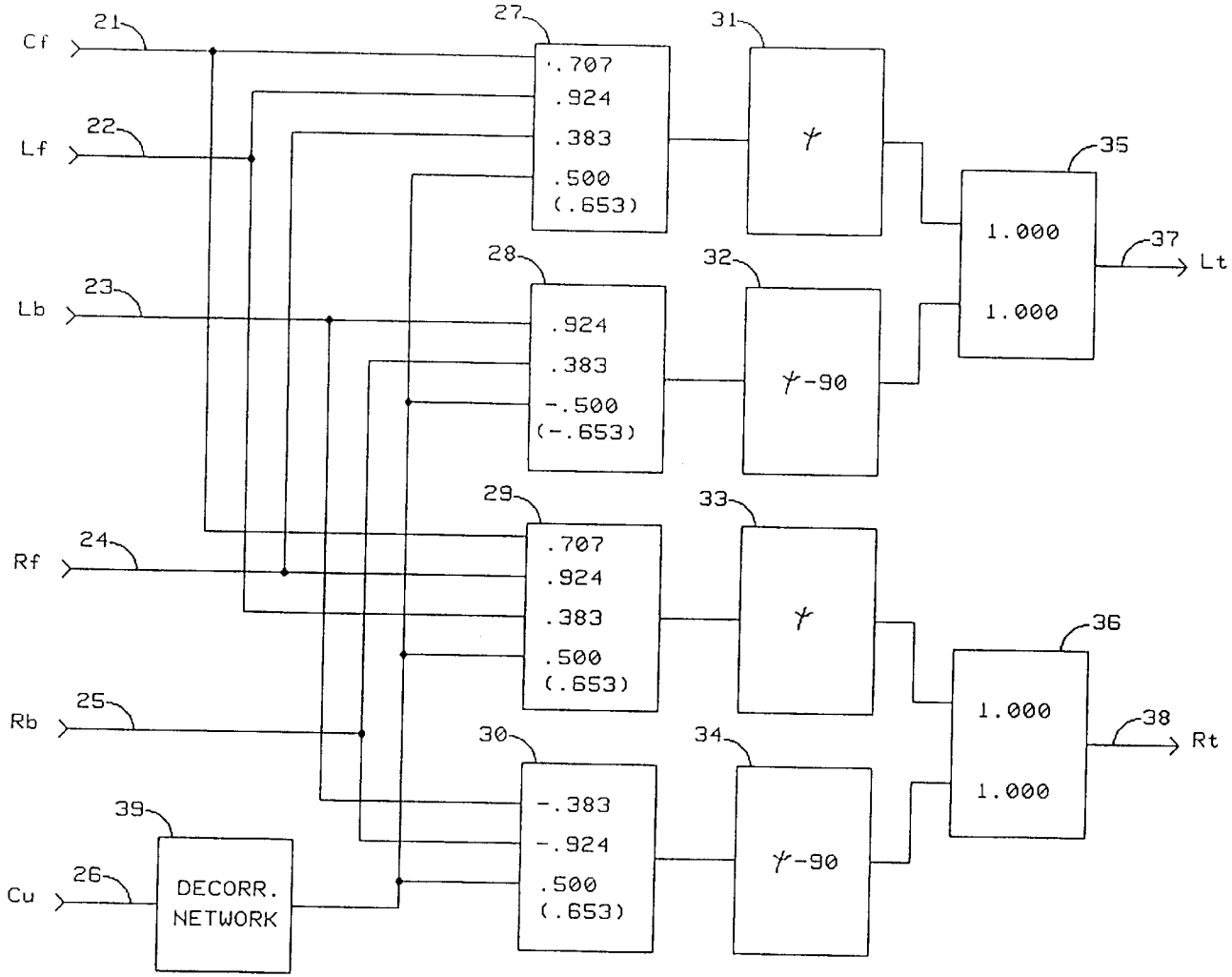
FIG. 3*b* is a schematic block diagram of an encoder including a decorrelation network permitting encoding of locations within the volume of a hemisphere.

FIG. 3*b* is a block diagram of the encoder of FIG. 3*a* modified by the addition of decorrelation network 39. Inputs 21 through 26 correspond respectively to inputs 1 through 6 of FIG. 3*a*; linear summers 27 through 30 correspond to 7 through 10; phase shifters 31 through 34 correspond to 11 through 14; output summers 35 and 36 to 15 and 16; outputs 37 and 38 to 17 and 18.

Decorrelation network 39 represents a function block, such as a known room-reverberation simulator, providing varying differential phase shift in the transmission/storage channels during the integration period of decoder "logic" direction sensing (typically a few milliseconds), or with change in frequency, such as an all-pass phase shifter ψ section, time delay or reverberation simulator as described above.

The addition of decorrelation network 39 makes it possible for the encoder to pan through the volume of the hemisphere representing the playback space as illustrated in FIG. 2, in contrast with the encoder of FIG. 3*a*, which is confined to encoding of locations on the audience plane and the hemispherical dome overhead (i.e. the surface of the hemisphere of FIG. 2). For example, pan-potting a signal at the encoder inputs from $C_U$ to C (the latter obtained by feeding $L_F$, $R_F$, $L_B$ and $R_B$ equally) will make the decoded and reproduced sound start directly overhead and move downward through the listening space to the center of the audience plane. This effect might be used to represent a helicopter hovering overhead and then descending into the middle of the audience. If this were tried with the encoder of FIG. 3*a*, the sound would start directly overhead, move outward and downward to the edge of the audience plane, and, from there, inward on the audience plane to its center. The decorrelation network gives the encoder of FIG. 3*b* the ability to pan directly through the volume of the audience room, including vertically. Circuits useable as decorrelation networks are described above with reference to FIG. 2 as examples a–g. A known "pan pot" may connected so that, at one limit of its travel, it applies an input signal to the encoder $C_U$ input, and at the other limit, to the $L_F$, $R_F$, $L_B$ and $R_B$ inputs yielding encoded C (Center). At an intermediate point on the pan path, there will be simultaneously encoded a $C_U$ signal and an equal C signal uncorrelated with the $C_U$ signal. This will cause decoder logic direction sensing to fail to sense specific encoded direction, disabling thereby the logic separation enhancement, and causing sound to emanate from all loudspeakers. This provides the conventional multi-speaker way of representing overall center of the space bounded by the loudspeakers. When the pan pot is displaced from the intermediate point toward the $C_U$ limit, the reproduced sound image will move upward, and when the pan pot is displaced toward the C limit, the sound image will move downward.

The encoders of FIGS. 3*a* and 3*b* both show coefficients of 0.500 applying to the $C_U$ input in the linear summers 7–10 or 27–30. This value yields unit-level encoded power $L_T^2+R_T^2$ for a unit-level $C_U$ signal. The encoder of FIG. 3*b* additionally shows optional coefficients of 0.653 in parentheses. Use of this value boosts encoded $C_U$ power by 2.3 dB to match encoded C power, resulting in maximum decorrelation (γ=1) between the signals in transmission/storage channels $L_T$ and $R_T$ when equal power is applied to $C_U$ and to C. This in turn results in encoding at the center of the $C_U$-C axis, shown in FIG. 2 as "$C_{.5U}$," with the input signal pan-potted equally to $C_U$ and C. With the 0.500 coefficients, encoded $C_{.5U}$ and γ=1 are attained with the input signal pan-potted to a point closer to $C_U$ than to C.

Figure 3C:
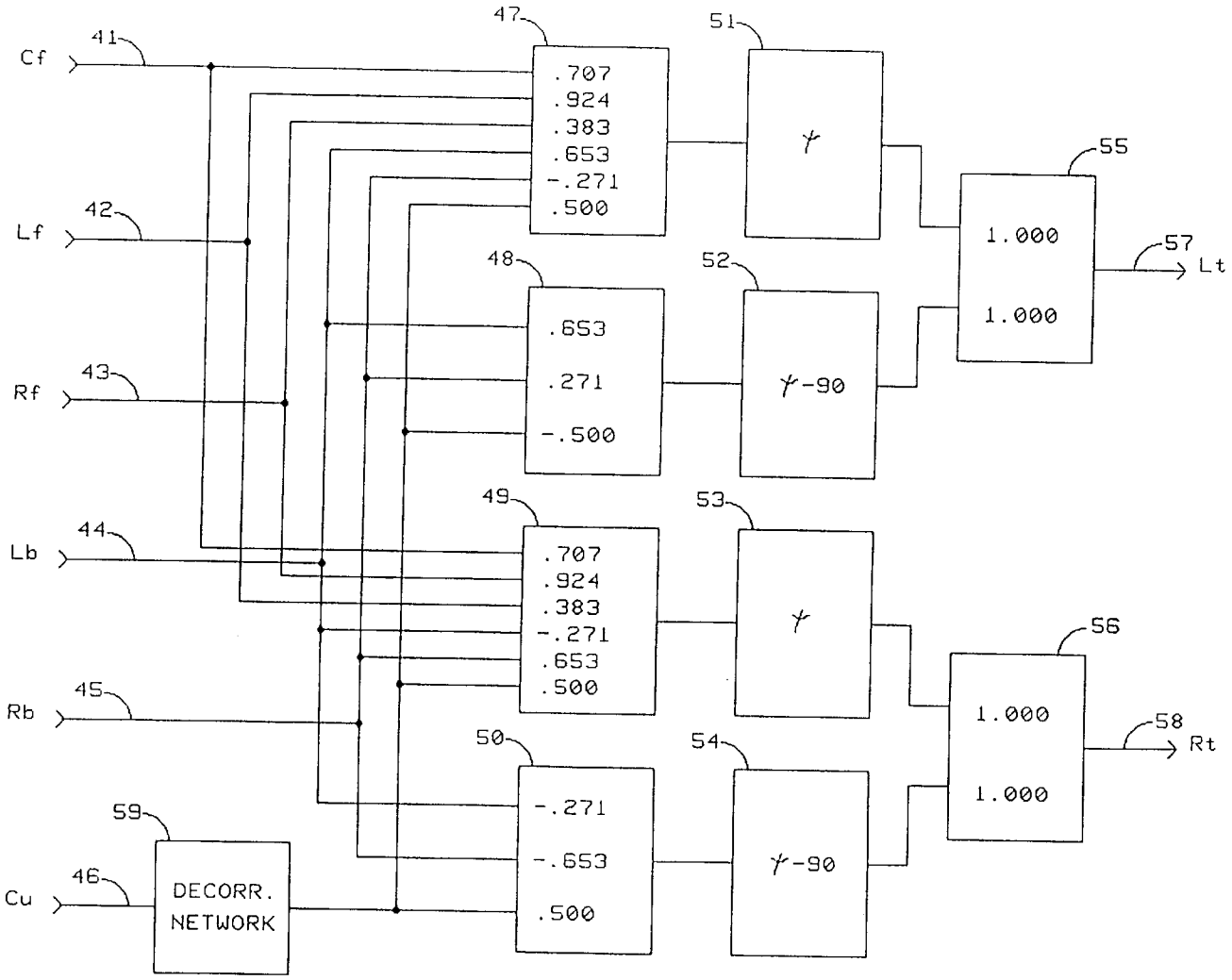
FIG. 3*c* is a schematic block diagram of a modification of the encoder of FIG. 3*b* providing improved compatibility with monophonic playback.

FIG. 3*c* is a schematic block diagram of a modification of the encoder of FIG. 3*b* providing improved compatibility with monophonic playback of the encoded program. Elements 41 through 59 in FIG. 3*c* correspond respectively to 21 through 39 in FIG. 3*b*.

The encoded signal $C_B$ is heard at −8.3 dB in monophonic reproduction of a program encoded by the encoder of FIG. 3*c*, in contrast to a level of −∞ when encoded by the encoder of FIG. 3*a* or FIG. 3*b*, and the encoded signal C localizes slightly more forward. Undecoded two-channel reproduction yields 15.3 dB separation for the phantom Center Left and Center Right ($C_L$ and $C_R$) locations with the encoder of FIG. 3*c*, in contrast with 7.7 dB for the encoders of FIG. 3*a* and FIG. 3*b*.

Figure 3D:
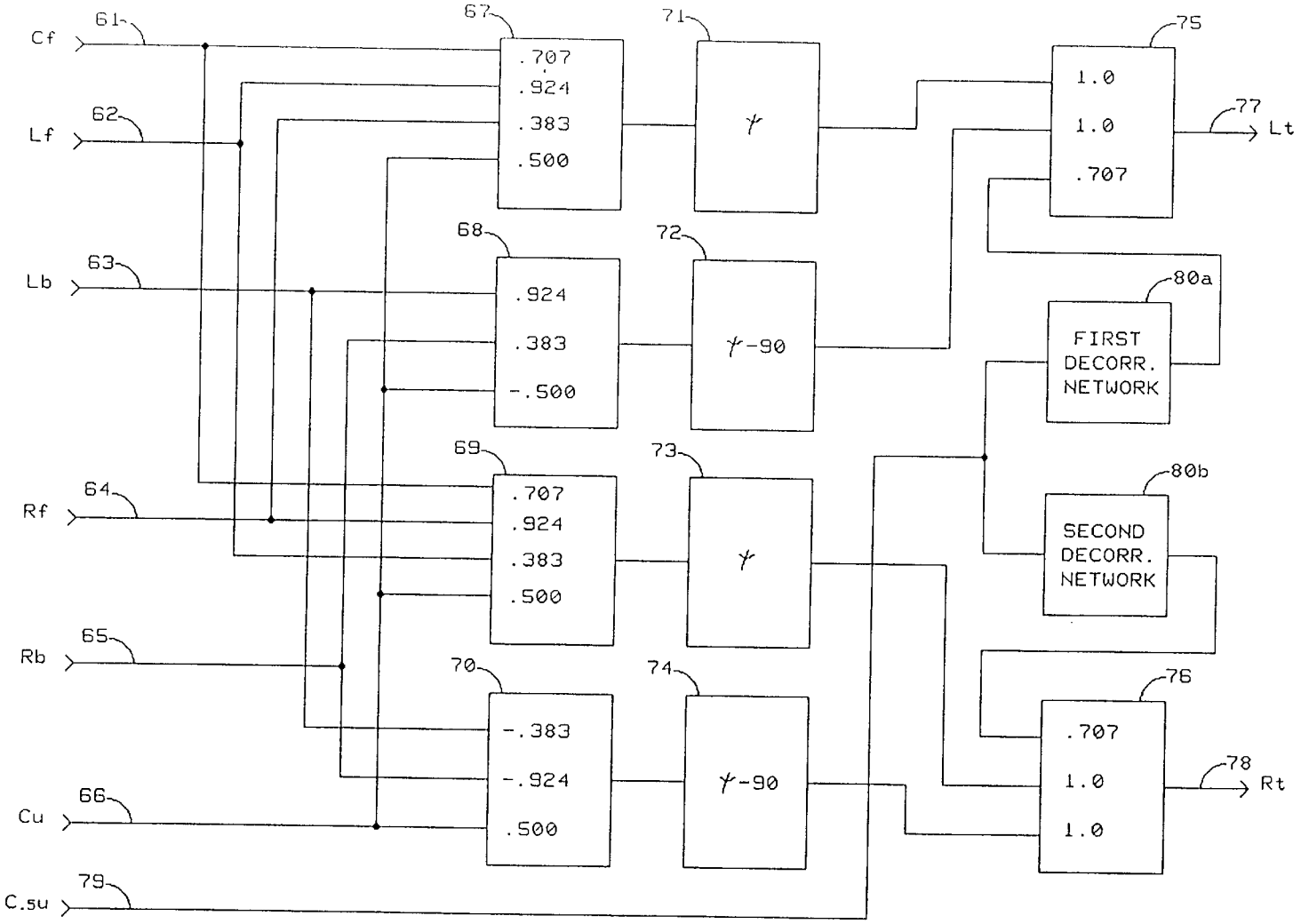
FIG. 3*d* is a schematic block diagram of an encoder providing a separate input for signals to be encoded within a hemispheric volume.

FIG. 3*d* is a schematic block diagram of an encoder having a separate input for a signal designated for reproduction at $C_{.5u}$, midway between the positions $C_U$ and C which mark the ends of the central, vertical hemispherical axis as shown in FIG. 2. Elements 61 through 78 of FIG. 3*d* correspond respectively to elements 41 through 58 in FIG. 3*c*. A separate encoder input 79 is provided for the $C_{.5U}$ signal. Decorrelation networks 80*a* and 80*b* have outputs that are decorrelated (as defined hereinabove) with reference to one another, in contrast with the decorrelator 39 and 59 of FIGS. 3*b* and 3*c*, which use a single decorrelation network whose output is decorrelated with reference to its input. Networks 80*a* and 80*b* may correspond to examples a, b, f or g discussed above with reference to FIG. 2.

Figure 3E:
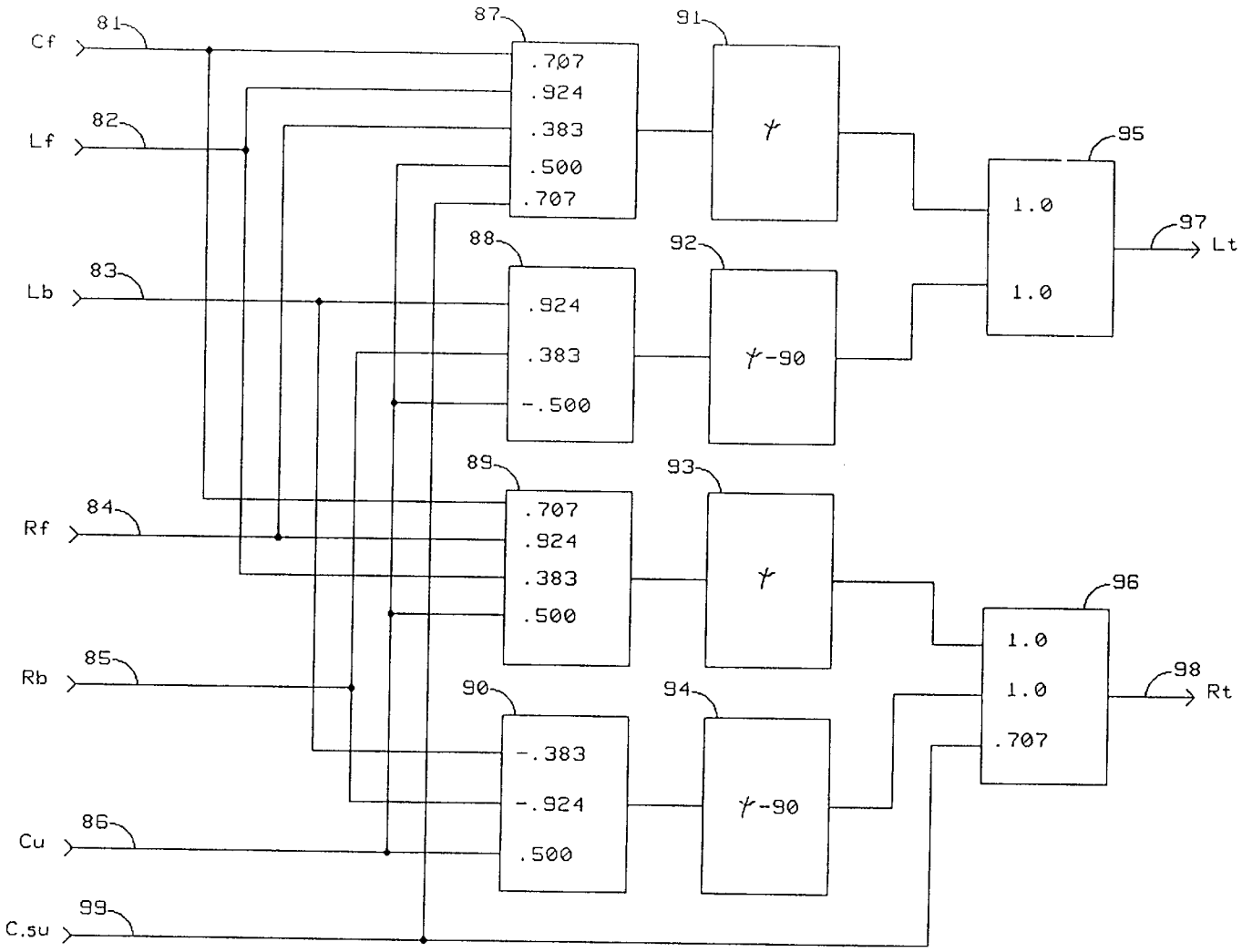
FIG. 3*e* is a schematic block diagram of a simpler circuit for the encoder of FIG. 3*d*.
Figure 4A:
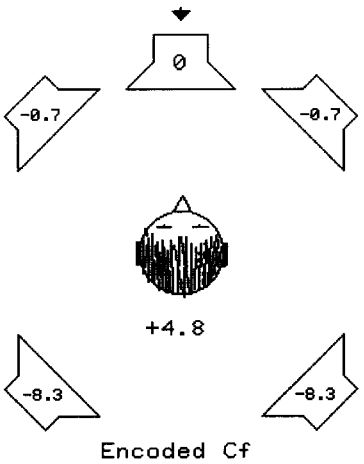
FIGS. 4*a–d* are schematic representations of decoded output levels obtained with the encoder of FIGS. 3*a*, 3*b*, 3*d* or 3*e* and a two-dimensional decoder employing a complementary matrix.
Figure 4B:
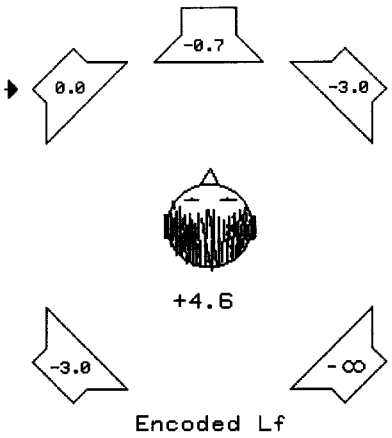
Figure 4C:
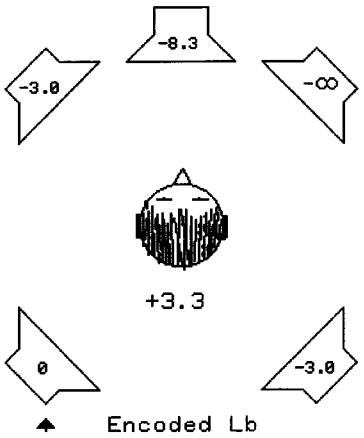
Figure 4D:
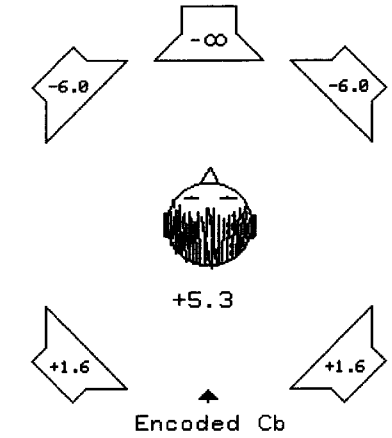

FIG. 3*e* is a schematic block diagram of a simplification of the encoder of FIG. 3*d*. In FIG. 3*e*, the $C_{.5U}$ input is applied to one of the transmission/storage channels through one of the all-pass phase shifters, and to the other transmission/storage channel without passing through an all-pass phase shifter, resulting in variation with frequency of the phase of the component of $C_{.5U}$ appearing in one channel with reference to that appearing in the other channel.

FIGS. 4*a–d* are a representation of decoded audience-plane output levels obtained with the encoders of FIGS. 3*a*, 3*b*, 3*d* or 3*e* and a prior art two-dimensional decoder employing a complementary matrix. This is, of course, for a basic matrix decoder prior to application of "logic" separation enhancement. The decoding matrix is described as complementary because each directionally-designated decoder output is decoded with the same spherical α,β coordinates as the correspondingly designated encoder input. For example, the decoded output designated to feed a loudspeaker at a Left Front position with reference to the center of the audience plane is decoded with the same α,β coordinates (135°, 0°) used for encoding a $L_F$ signal, etc. In each diagram of FIG. 4, encoded location is indicated by a caption and an arrow pointing to the intended location of reproduction, and actual decoded levels (in dB) in the various decoded outputs for the indicated encoded location are shown as numbers within loudspeaker symbols. Total radiated power comprising the sum of the squares of the signals in all shown outputs appears just below center in each diagram. Since the system is left-right symmetrical, separate diagrams are not needed for signals encoded at right locations, their patterns being mirror images of those for left locations.

The biggest problem revealed in FIG. 4 is the "channel separation" of only 0.7 dB from $C_F$ to $L_F'$ and $R_F'$, and from $L_F$ (or $R_F$) to $C_F'$. This problem is a consequence of using the above-described prior art "rotationally-symmetrical" encode-decode matrix and adding the $C_F$ channel intermediate to the $L_F$ and $R_F$ channels. As described hereinabove, at least an approximation of rotationally symmetrical encoding is necessary to convey mean directional information (non-random relative phase in $L_T$ and $R_T$) to the decoder logic when multiple directional signals occur simultaneously in a program.

Figure 5B:
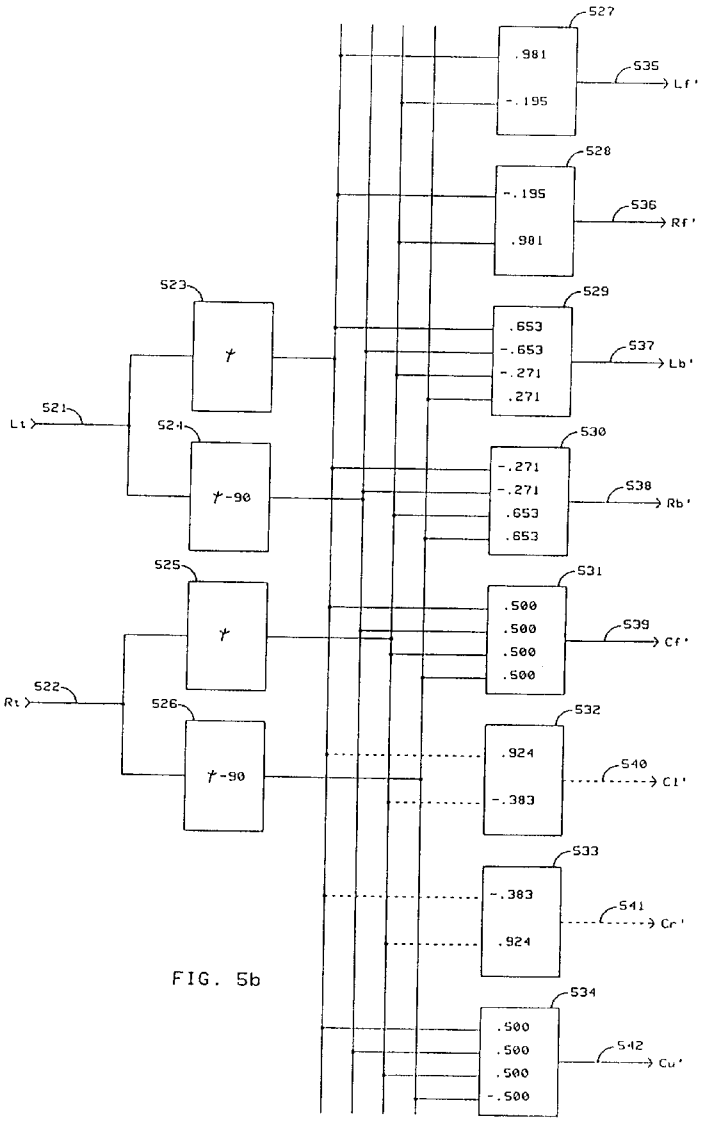
FIG. 5*b* is a schematic block diagram of a three-dimensional decoder employing a matrix non-complementary to the encode matrix of FIGS. 3*a–e*.
Figure 5A:
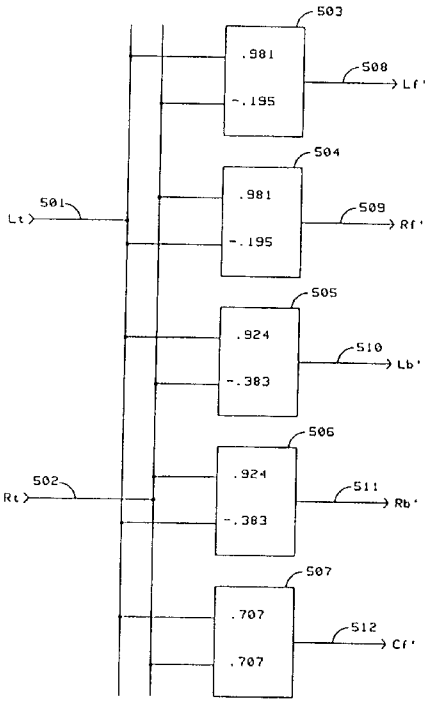
FIG. 5*a* is a schematic block diagram of a two-dimensional decoder employing a matrix non-complementary to the encode matrix of FIGS. 3*a–e*.

FIG. 5*a* is a schematic block diagram of a two-dimensional decoding matrix of the present invention made non-complementary to the encoding matrix in order to attain an improved distribution of channel separation without compromising rotationally symmetrical encoding. Elements 501 and 502 are respective inputs for receiving transmission/storage-channel signals $L_T$ and $R_T$; 503 through 507 are linear summers having indicated summing signs and coefficients; 508 through 512 are respective decoded outputs $L_F'$, $R_F'$, $L_B'$, $R_B'$ and $C_F'$. The prime (') sign distinguishes decoded outputs from directional signals to be encoded.

FIG. 5*b* is a schematic block diagram of a three-dimensional decoding matrix of the present invention providing all of the outputs of the two-dimensional matrix of FIG. 5*a* plus an overhead ($C_U'$) output and optional Center Left and Center Right ($C_L'$ and $C_R'$) outputs. 521 and 522 are respective $L_T$ and $R_T$ inputs; 523 through 526 are known differential all-pass phase shifters, with 523 and 525 providing reference zero-degree phase and 524 and 526 providing ninety-degree phase with reference to the reference zero-degree phase throughout the audio-frequency band. 527 through 534 are linear summers having indicated summing signs and coefficients; 535 through 542 are the respective $L_F'$, $R_F'$, $L_B'$, $R_B'$, $C_F'$, $C_L'$, $C_R'$ and $C_U'$ outputs.

Since the all-pass phase shifters are used to decode the $C_U'$ output, they are also used to optimize acoustical phase relationships between pairs of loudspeakers for better localization of center phantom images.

Figure 6A:
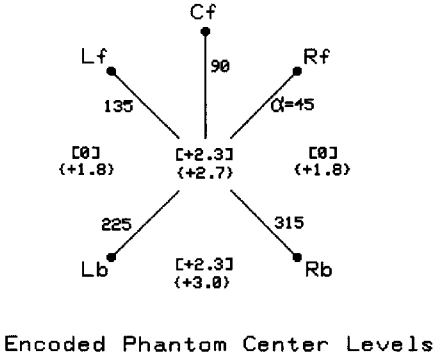
FIGS. 6*a–f* are schematic representations of decoded output levels obtained with ideal Scheiber-sphere encoding of all positions, with $C_L$ and $C_B$ encoded as phantom centers by the encoders of FIGS. 3*a–e*, as decoded by the decoders of FIGS. 5*a* and 5*b*.
Figure 6B:
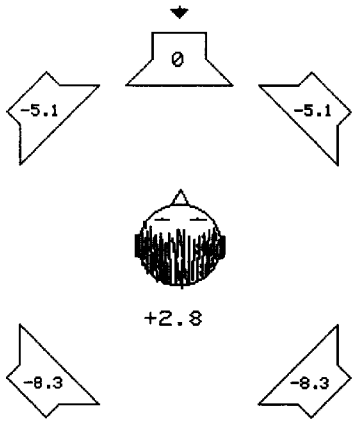
Figure 6C:
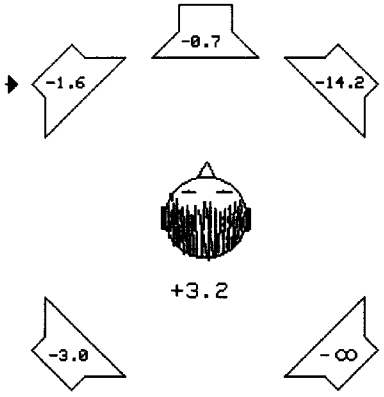
Figure 6D:
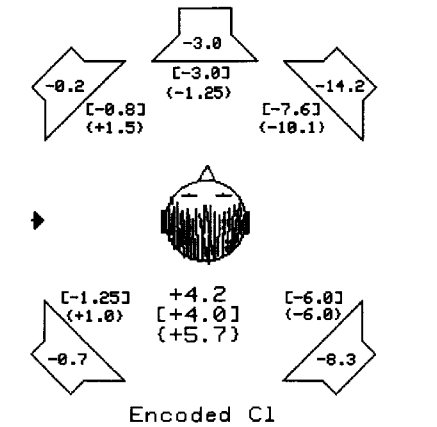
Figure 6E:
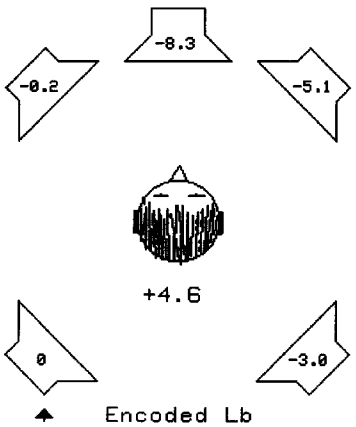
Figure 6F:
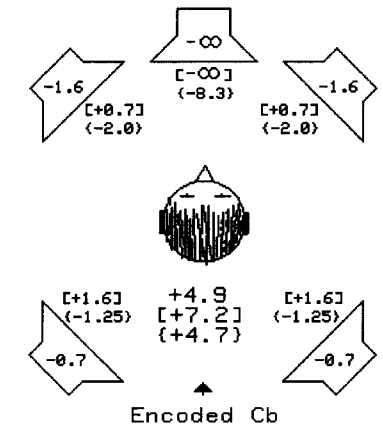
Figure 7A:
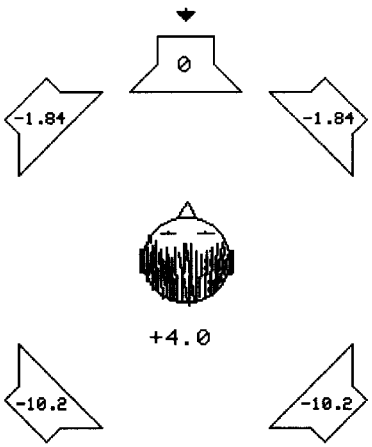
FIGS. 7*a–d* are schematic representations of decoded output levels obtained with complementary, pentagonal encoding and decoding.
Figure 7B:
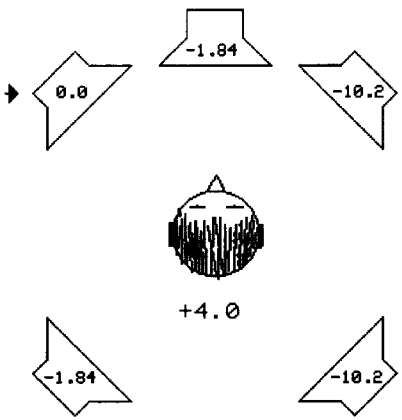
Figure 7C:
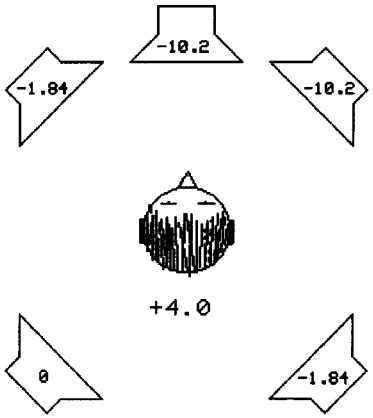
Figure 7D:
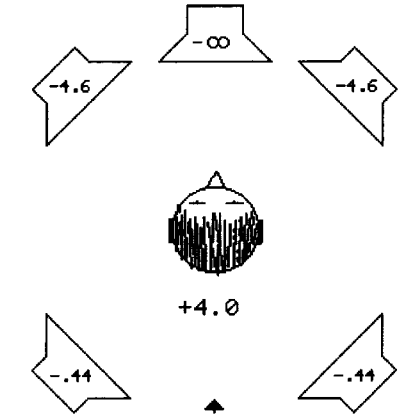

FIGS. 6*a–f* are representations of decoded audience-plane output levels obtained with "ideal" rotationally symmetrical encoding and with the encoders of FIGS. 3*a–e*, and the decoders of FIGS. 5*a–e*. As described hereinabove with respect to FIGS. 4*a–d*, encoded location is indicated by captions and arrows, decoded output levels in dB appear as numbers within loudspeaker symbols, and total radiated power in dB appears as a number just below the center of each diagram. Where the results with the encoders of FIGS. 3*a–e* differ from those with "ideal" encoding, those for FIGS. 3*a*, 3*b*, 3*d* and 3*e* are shown in brackets ([ ]) and those for "mono-compatible" FIG. 3*c* are shown in braces ({ }). FIG. 6*a* shows encoded phantom center levels in dB for the encoders of FIGS. 3*a–*3*e* (always 0 dB with "ideal" encoding), with 0 dB defined as $L_T^2+R_T^2=1$.

Comparing the (unenhanced) separation patterns of the complementary decoder as illustrated in FIGS. 4*a–d* with those of the non-complementary decoder as illustrated in FIGS. 6*a–f* shows the following: Separation from $C_F$ to $L_F'$ and $R_F'$ for complementary decoders is 0.7 dB, and for non-complementary decoders is 5.1 dB; separation from $L_F$ and $R_F$ to $C_F'$ for complementary decoders is 0.7 dB, and for non-complementary decoders is −0.9 dB; separation across the frontal "stage" from $L_F$ to $R_F'$ and from $R_F$ to $L_F'$ for complementary decoders is 3 dB, and for non-complementary decoders is 12.6 dB. Prior to application of logic separation enhancement, non-complementary decoding yields a tighter Center Front image and much less crosstalk across the "stage" than complementary decoding. With the $L_F'$ and $R_F'$ loudspeakers spaced wider that the width of a picture screen, as in a typical video setup, the audio stage bounded by phantom $L_F$ and $R_F$ will be narrowed to coincide more closely with the picture screen, but with minimal contribution of displacement of the $L_F$ image by the $R_F'$ speaker on the other side of the stage; and similarly for the $R_F$ image and the $L_F'$ speaker. An $L_F$ (or $R_F$) image created by two loudspeakers having angular spacing θ and reproducing $L_F$ (or $R_F$) at levels differing by 0.9 dB, as for the non-complementary decoding of FIG. 6*a*, will be more positionally stable than the image created by two loudspeakers having angular spacing of 2θ and reproducing the same sound at levels differing by 3.0 dB, as is the case for the complementary decoding of FIGS. 4*a–d*. In the decoder of FIG. 5*b*, the $L_F$ and $R_F$ signals appearing in the $C_F'$ output are made to lag the same signals appearing in $L_F'$ and $R_F'$ by 45°, providing a slight subjective outward shift to the reproduced $L_F$ and $R_F$ images.

If such phantom images for $L_F$ and $R_F$ (prior to logic separation enhancement) are not desired, and more emphasis is desired on five channels as such, as distinguished from reproduced directionality, something closer to a regular pentagonal matrix, with spacing of Δα=72° corresponding to 1.84 dB electrical separation between all adjacent channel pairs, may be appropriate. FIGS. 7*a–d* are representations of decoded audience-plane output levels obtained with complementary, regular pentagonal encoding/decoding.

Figure 8:
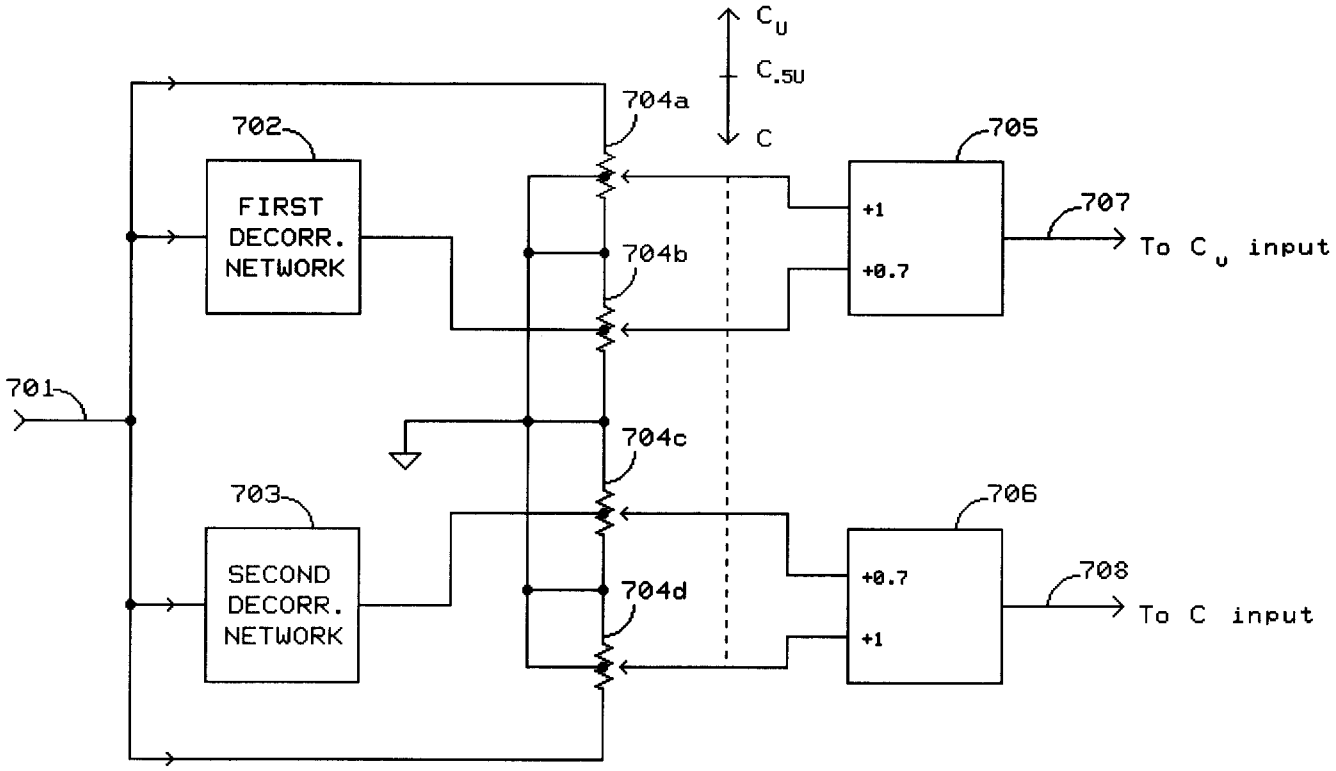
FIG. 8 is a schematic block diagram of means for moving sound-source position along a central, vertical axis in a hemisphere.

FIG. 8 shows an alternative means for panning continuously through the volume of a hemisphere along the central, vertical axis as shown in FIG. 2. 701 is an input for receiving the signal to be panned. 702 and 703 are respective first and second decorrelation networks as described hereinabove with reference to FIG. 3*d*. 704*a–d* is a center-tapped, linear, four-gang potentiometer. 705 and 706 are linear summers with coefficients as shown. 707 and 708 are outputs for application to the respective $C_U$ and C inputs of an encoder such as that of FIG. 3*a*. When the potentiometer is at the top end of its excursion, only 707 carries a signal and there is no decorrelation ($\gamma$=0). At mid-excursion, $C_U$ and C carry mutually decorrelated signals ($\gamma$=1); at the bottom excursion limit, only 708 carries a signal and there is no decorrelation.

While it is clear from the above description that decorrelation should vary along the vertical, central spatial axis so as to be maximum at the midpoint ($C_{.5U}$) and zero at the end points ($C_U$, C), it is useful to define a preferred variation of decorrelation as the encoded position is panned frontward or backward, leftward or rightward from fully-decorrelated $C_{.5U}$. In panning from $C_{.5U}$ frontward or backward and downward toward $C_F$ or $C_B$, decorrelation $\gamma$ should preferably diminish smoothly to zero at $C_F$ or $C_B$ (as is desired when panning upward or downward along the central vertical axis toward $C_U$ or C). Phase difference in $L_T$ and $R_T$ should flip from 90° to 0° for a small displacement forward of $C_{.5U}$, and to 180° for a small displacement backward of $C_{.5U}$, while amplitude ratio in $L_T$ and $R_T$ remains at unity. In panning from $C_{.5U}$ leftward or rightward and downward toward $C_L$ or $C_R$, $\gamma$ should remain at maximum (nominal unity) value, rendering phase difference in $L_T$ and $R_T$ immaterial, and amplitude ratio should follow the leftward or rightward displacement, with $R_T$ vanishing as the pan reaches $C_L$, and $L_T$ vanishing as the pan reaches $C_R$.

Figure 9:
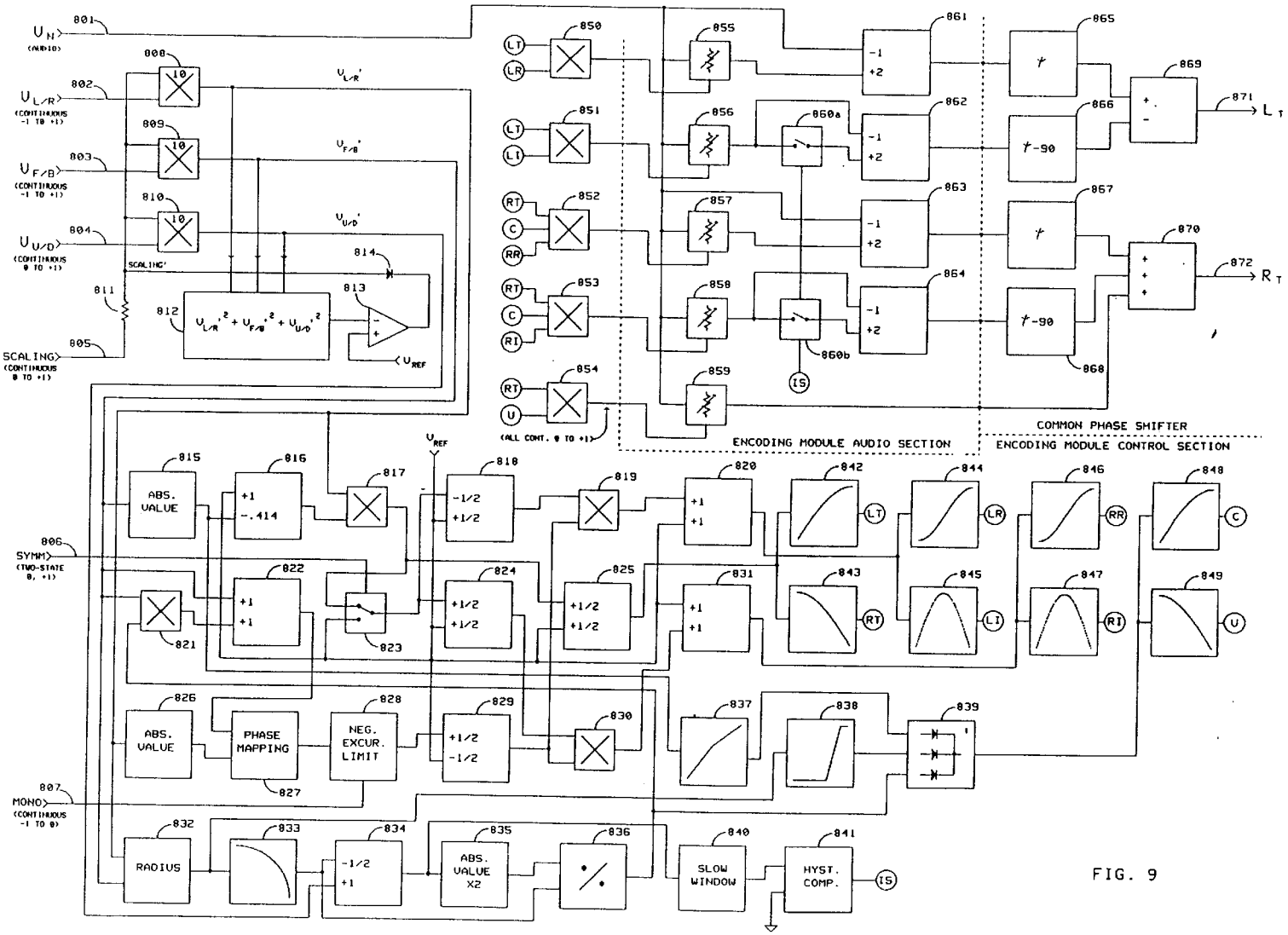
FIG. 9 is a schematic block diagram of an encoder providing 3-axis localization of an input signal in response to control signals representing 3-axis position.

FIG. 9 is a schematic block diagram of a three-dimensional encoder which includes encoding modules, each pannable to any desired location in three-dimensional (left/right, front/back, up/down) space in response to control signals representing three-dimensional location. Outputs from a plurality of encoding modules, each receiving a single audio input signal and comprising an audio section and a control section, may be summed in a common phase shifter. This encoder employs decorrelation to permit encoding of sounds within a spatial volume, with upward, downward, leftward, rightward, frontward and backward panning within the volume in accordance with the above discussion with reference to FIG. 8.

With reference to FIG. 9, elements 855 through 864 comprise the encoding module audio section for a single input signal to be panned in space. 808 through 854 comprise the encoding module control section for a single input signal, and 865 through 870 comprise a common phase shifter receiving the outputs of a plurality of encoding modules. Elements 808 through 814, part of the encoding module control section, comprise a radius scaler to permit scaling of the dimensions of the encoded/decoded, or virtual, sound environment (1) to coincide with the dimensions of the physical audience space as defined by the locations of the peripheral and overhead playback loudspeakers, or (2) to comprise any desired multiple (or fraction) of the audience-space dimensions. 801 is an input receiving the audio signal to be encoded. 802 through 804 are respective left/right, front/back and up/down control-signal inputs. A continuously-variable scaling signal is received at input 805. Input 806 receives a two-state "symmetry" signal determining the proportion of differential phase shift $\beta$ to be applied to respective $L_T$ and $R_T$ signals, which may be useful for optimizing encoding of sound signals applied to more than one input module. 807 receives a "mono compatibility" control signal providing a continuously adjustable limit to "out-of-phaseness" with which nominally Center Back audio signals are encoded ($V_{F/B}$=−1); with the mono control signal at nominal −1, $C_B$ is permitted to go to full out-of-phase ($L_T$−$R_T$=180°). 871 and 872 are encoder audio outputs for application to respective transmission/storage channels $L_T$ and $R_T$.

In the embodiment of FIG. 9, position is measured from the center of the audience plane, where all position-control signals have a nominal value of zero. Full left position (signal to be encoded at $C_L$) for left/right control signal $V_{L/R}$ at 802 is designated as having a nominal value of −1 and full right, +1. Full front position (the signal to be encoded at $C_F$) for front/back control signal $V_{F/B}$ at 803 is designated +1 and full back, −1. Full up position (the signal to be encoded at $C_U$) for up/down control signal $V_{U/D}$ at 804 is designated +1 and full down, 0 (the reference location, center of the audience plane, is the lower limit of the up/down pan). The voltage value of the various control signals is generally +10V for a full positive excursion of nominally +1 and −10 V for a full negative excursion of nominally −1.

Resistor 811 permits the output of the voltage comparator 813 to control the upper inputs to ×10 multipliers 808–810 when the output of the radius-sensing circuit 812 exceeds a reference voltage $V_{REF}$ and diode 814 conducts, reducing the gains applied by 808–810 to respective $V_{L/R}$, $V_{F/B}$ and $V_{U/D}$ by a common factor. Conduction of diode 814 is initiated when the encoded radius (distance of the encoded position from the reference center of the audience plane), as measured by the sum of the squares of $V_{L/R}$, $V_{F/B}$ and $V_{U/D}$, reaches or exceeds the hemispherical boundary of the intended playback space as bounded by the audience-plane and overhead loudspeakers. Depending on the magnitude of the scaling signal applied to 805, reaching the boundary may coincide with encoding at maximum radius ($V_{L/R}^2+V_{F/B}^2+V_{U/D}^2=1$), or at a smaller radius. In the latter case, the sum of the squares of scaled voltages $V_{L/R}'$, $V_{F/B}'$ and $V_{U/D}'$ reaches the limiting value of unity when the sum of the squares of input $V_{L/R}$, $V_{F/B}$ and $V_{U/D}$ is less than unity. As input $V_{L/R}^2+V_{F/B}^2+V_{U/D}^2$ continues to increase, representing motion of the panning audio input signal through and beyond the hemispherical boundary of the listening space, $V_{L/R}':V_{F/B}':V_{U/D}'$ is maintained identical to $V_{L/R}:V_{F/B}:V_{U/D}$ so that sound-source direction continues to be encoded correctly for sounds placed further away from the center of the audience plane than the hemispherical boundary (outside the physical playback space). Within the scaled boundary, i.e., within the volume of the audience space, radius (encoded distance from center of the audience plane) is varied by varying decorrelation; outside the scaled boundary, reached when a radius of less than unity (maximum) as measured at 802–804 is scaled up to be limited to unity at the outputs of 808–810, the radius scaler maintains correct encoded directionality, while external circuits such as reverberation simulating varying spatial dimensions, Doppler effect, and shaping of frequency response and/or attacks may be applied to audio signal $V_N$ to suggest changing distance. In this way, the radius scaling feature of the encoder of FIG. 9 allows the apparent aural listening space to be expanded to any volume, even a volume that is many times larger than the physical volume defined by speaker placement in the listening environment.

Figure 12:
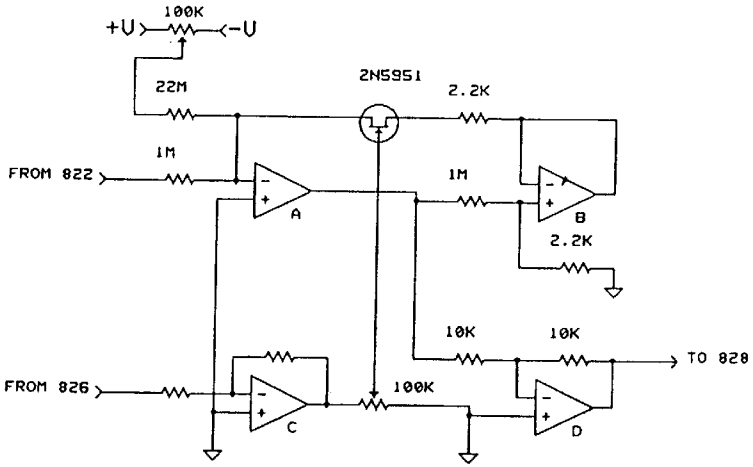
FIGS. 10–12 are schematic diagrams of individual blocks in the diagram of FIG. 9.

815 is a known absolute-value circuit. 816 is a linear summer with indicated coefficients. 817 is a multiplier. 818 is a linear summer with indicated signs and coefficients. 819 is a multiplier. 820 is a linear summer. 821 is a multiplier. 822 is a linear summer. 823 is an electronic double-throw switch controlled by the symmetry input 806. 824 and 825 are linear summers with indicated coefficients. 826 is a known absolute value circuit. Phase-mapping circuit 827 is a "reciprocal circle multiplier" which divides the signal on its upper input by the square root of one minus the square of the signal on its lower input; a preferred embodiment circuit is shown in FIG. 12. 828 sets an adjustable negative excursion limit to the control voltage determining "out-of-phaseness" of rearward-panned sounds; a preferred embodiment circuit its shown in FIG. 10. 829 is a linear summer with indicated signs and coefficients. 830 is a multiplier. 831 is a linear summer. 832 calculates radius on the audience plane, calculating the square root of the sum of the squares of the signals on its inputs. 833 calculates the square root of one minus the square of the signal on its input. 834 is a linear summer with indicated signs and coefficients. 835 is a known absolute value circuit with a gain of two. 836 is a divider. 837 applies a transfer characteristic as shown to the absolute value of $V_{F/B}'$ for use in controlling decorrelation for rotational symmetry in front-back movement as compared to left-right movement. Its output signal is 1.272 times its input signal when its input signal is less than nominal 0.5 (half of limiting excursion); its output signal is 0.728 times the input signal plus 0.272 (with reference to full excursion) when the input signal is greater than 0.5. 838 applies a transfer characteristic as shown to the audience-plane radius signal for use in controlling decorrelation. The output is zero for inputs less than approximately 0.9 (0.9 times maximum excursion); the output is +1 (full excursion) when the input is greater than approximately 0.9. The output of 839 is equal to the largest of its three input signals and corresponds to the correlation ($1-\gamma$ as shown in FIG. 2). 840, a "slow window," limits its output slewing rate to 0.1×full excursion per 10 milliseconds when its input signal is within the range ±0.1 (with reference to maximum excursion of ±1). "Hysteresis comparator" 841 derives the sign of the output of 840, with hysteresis covering a range of ±0.1×maximum excursion. The output of 841, designated "IS," controls the sign of the imaginary components of the audio input signal in $L_T$ and $R_T$, and is applied to the similarly-designated point on electronic switch 860*a,b*. 842 and 843 are respective quarter-sine and quarter-cosine transfer characteristics as shown. Their outputs, designated respective LT and RT, are applied to the similarly-designated points on multipliers 851–854 to determine the gains associated with the encoder $L_T$ and $R_T$ outputs. 844 and 845 have the respective functions of 0.5(1−cos 180°) times the input and 0.5(1+sin 180°) times the input. The respective outputs, designated "LR" and "LI," control the amounts of respective real and imaginary components of the encoded audio signal in $L_T$, and are applied to the similarly-designated points on multipliers 850 and 851. 846 and 847, like 844 and 845, have the respective functions of 0.5(1−cos 180°) times the input and 0.5(1+sin 180°) times the input. The respective outputs, designated "RR" and "RI," control the amounts of respective real and imaginary components of the encoded audio signal in $R_T$, and are applied to the similarly-designated points on multipliers 852 and 853. 848 and 849 are respective quarter-sine and quarter-cosine transfer characteristics as shown. Their outputs, designated respectively "C" and "U," control the relative amounts of mutually correlated and uncorrelated signal components applied to $L_T$ and $R_T$, and are applied to the similarly designated points on multipliers 852, 853 and 854. 850 through 854 are multipliers receiving control signals from curve generators 842–849 and applying them to variable-gain elements 855 through 859 which determine relative strength of real, imaginary and uncorrelated audio signal components applied to $L_T$ and $R_T$.

For simplicity, in FIG. 9, the decorrelated signal component controlled by variable-gain element 859 is derived by bypassing all-pass phase shifters 865–868, resulting in the phase of this signal component varying with frequency as compared with all the other audio signal components appearing in the $L_T$ and $R_T$ outputs. A better decorrelated signal component could be obtained by inserting a room-reverberation-simulating circuit at the output of 859.

As previously stated, electronic switches 860*a* and 860*b* determine the sign of the imaginary components. 861 through 864 are linear summers having signs and coefficients as shown. 865 through 868 are known all-pass phase shifters with nominal phases as shown, as previously described with reference to the encoders of FIGS. 3*a–e*. 869 and 870 are linear summers with unity coefficients and signs as shown. 871 and 872 are the respective encoded $L_T$ and $R_T$ program outputs.

Figure 11:
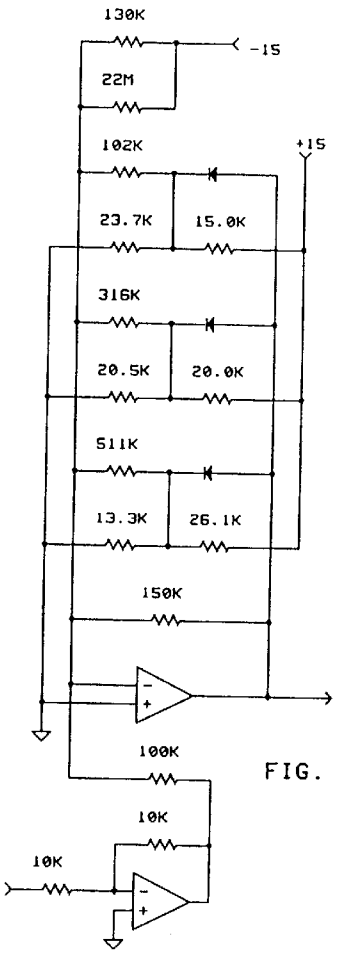
Figure 10:
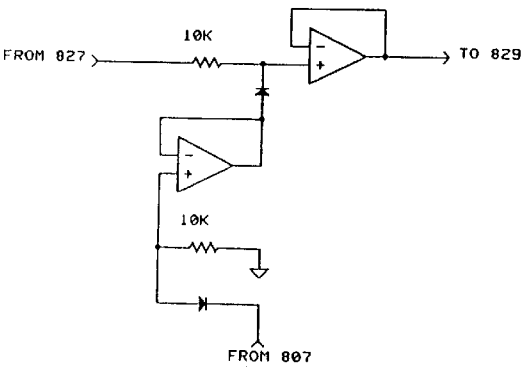

FIG. 10 shows a preferred embodiment realization of element 828 in FIG. 9. FIG. 11 shows a preferred embodiment realization of a quarter-sine curve as shown in 842 and 848 of FIG. 9. Practical realizations of all quadrants of sine and cosine curves are known in the art. FIG. 12 shows a preferred embodiment realization of element 827 in FIG. 9. With the exception of the 22M Ohm, resistors are preferably close-tolerance types. The pot connected to the 22M Ohm resistor is for offset nulling and the pot connected to the FET gate is for scaling to the pinchoff voltage of the individual FET. The unmarked resistors are selected to scale the function of 827 to the actual voltage range of the input signals. The transfer characteristic should follow the function of element 827 specified above with reference to FIG. 9 fairly accurately (within a few per cent) up to an excursion of 0.8 of the input received from element 826, and then rise more rapidly than the calculated function.

While the invention has been illustrated and described in detail in the drawings and foregoing description, the same is to be considered as illustrative and not restrictive in character, it being understood that only the preferred embodiment has been shown and described and that all changes and modificaitons that come within the spirit of the invention are desired to be protected.

I claim:

1. Encoder apparatus for a three-dimensional position-mapping stereo sound reproduction system using a pair of transmission or storage channels, said apparatus comprising a hemispherical sound location encoder having input(s) for sound signals designated for reproduction from selected positions within or on the periphery of a volume representing a playback space, and having at least two-channel output, said encoder including:

means for hemispherical directional encoding of a sound input signal to apply said signal with a selected differential phase shift to the transmission or storage channels, said differential phase shift having a first sense of phase-leading vs. phase-lagging (positive vs. negative imaginary signal component in the differential phase shift), where said differential phase shift represents spherical elevation angle of the sound input signal on the surface of a hemispherical dome bounded on the bottom by the plane of the audience in the playback area, said elevation angle measured around the left/right central axis of the audience plane; and further having means for hemispherical directional encoding of a sound input signal to apply said signal with a selected amplitude ratio and relative polarity (positive vs. negative real signal component in the differential phase shift) to said transmission or storage channels where said amplitude ratio and relative polarity represent azimuth angle of said sound input signal;

means for audience-plane positional encoding of a sound input signal to apply said signal with a selected differential phase shift to the transmission or storage channels, said differential phase shift having a sense of phase-leading vs. phase-lagging (positive vs. negative imaginary signal component in the differential phase shift) opposite to that used for directional encoding on the surface of said hemispherical dome, where said differential phase shift represents front/back position of the sound input signal on the audience plane; and further having means for audience-plane positional encoding of a sound input signal to apply said signal with a selected amplitude ratio to said transmission or storage channels where said amplitude ratio represents left/right position of said sound input signal on the audience plane;

means for positional encoding of a sound input signal in the transmission or storage channels to apply said signal to said channels with a substantially 90° differential phase shift in one sense of phase-leading vs. phase-lagging, and to have equal amplitudes in both channels, said 90° differential phase shift and equal amplitudes representing a "Center Up" direction and a full or nominally unity radius or distance with respect to the center of the audience plane, corresponding to a "center top" location on a unit-radius hemispherical dome; and means for encoding a sound input signal in the transmission or storage channels to apply said signal to said channels with a substantially 90° differential phase shift in the opposite sense of phase-leading vs. phase-lagging, and to have equal amplitudes in both channels, said opposite 90° differential phase shift and equal amplitudes representing a Center position in the audience plane having a substantially zero radius or distance with respect to the center of the audience plane.

2. Encoder apparatus for a three-dimensional position-mapping stereo sound reproduction system using a pair of transmission or storage channels, said apparatus comprising a hemispherical sound location encoder having input(s) for sound signals designated for reproduction from selected positions within or on the periphery of a volume representing a playback space, and having at least two-channel output, said encoder including:

means for hemispherical directional encoding of a sound input signal to apply said signal with a selected differential phase shift to the transmission or storage channels, said differential phase shift having a first sense of phase-leading vs. phase-lagging (positive vs. negative imaginary signal component in the differential phase shift), where said differential phase shift represents spherical elevation angle of the sound input signal on the surface of a hemispherical dome bounded on the bottom by the plane of the audience in the playback area, said elevation angle measured around the left/right central axis of the audience plane; and further having means for hemispherical directional encoding of a sound input signal to apply said signal with a selected amplitude ratio and relative polarity (positive vs. negative real signal component in the differential phase shift) to said transmission or storage channels where said amplitude ratio and relative polarity represent azimuth angle of said sound input signal;

means for audience-plane positional encoding of a sound input signal to apply said signal with a selected differential phase shift to the transmission or storage channels, said differential phase shift having a sense of phase-leading vs. phase-lagging (positive vs. negative imaginary signal component in the differential phase shift) opposite to that used for hemispherical directional encoding, where said differential phase shift represents front/back position of the sound input signal on the audience plane; and further having means for audience-plane positional encoding of a sound input signal to apply said signal with a selected amplitude ratio to said transmission or storage channels where said amplitude ratio represents left/right position of said sound input signal on the audience plane;

means for vertical positional encoding of a sound input signal to apply said signal to the transmission or storage channels with selected quasi-decorrelation involving variation with frequency of differential phase in said channels, where said quasi-decorrelation represents at least proximity of the sound input signal to the midpoint of a vertical axis within a hemispherical volume bounded on the top by said hemispherical dome, and on the bottom, by said audience plane;

means for positional encoding of a sound input signal in the transmission or storage channels to apply said signal to said channels with a substantially 90° differential phase shift in one sense of phase-leading vs. phase-lagging, and to have equal amplitudes in both channels, said 90° differential phase shift and equal amplitudes representing a "Center Up" direction and a full or nominally unity radius or distance with respect to the center of the audience plane corresponding to a "center top" location on a unit-radius hemispherical dome; and means for encoding a sound input signal in the transmission or storage channels to apply said signal to said channels with a substantially 90° differential phase shift in the opposite sense of phase-leading vs. phase-lagging, and to have equal amplitudes in both channels, said opposite 90° differential phase shift and equal amplitudes representing a Center position in the audience plane having a substantially zero radius or distance with respect to the center of the audience plane; and further having means for encoding a sound input signal in the transmission or storage channels to apply said signal so as to be quasi-decorrelated in respective said channels, where quasi-decorrelation involves variation with frequency of differential phase in said channels, and to have approximately equal overall amplitudes in both channels, said quasi-decorrelation and approximately equal overall amplitudes representing a position, within a hemispherical volume, substantially at the midpoint of a central vertical axis connecting the Center Top of the hemispherical dome with the Center of the audience plane.

3. The process of decoding positions associated with sound signals contained in two or more transmission or storage channels and having 3-dimensional sound-source position information encoded by at least phase-amplitude relationships in said channels comprising the steps of:

(a) applying said transmission or storage channels to a two-or-more-channel input and four-or-more-channel output 3-dimensional decoder in which the dominant or strongest one(s) of outputs intended for reproduction on the periphery of the horizontal plane of the audience are determined by amplitude ratio and polarity difference (sign of real component of difference) between the signals in said transmission or storage channels, degree of dominance decreasing as amplitude ratio between said signals approaches unity in combination with phase difference approaching ninety degrees in either sense (±90°); and amplitude of an output intended for overhead reproduction increasing relative to that of the audience-plane outputs as amplitude ratio between said signals approaches unity in combination with phase difference approaching ninety degrees in one sense; with reproduction of quasi-decorrelated signals in said transmission or storage channels (signals whose different spectral components have different relative phases in said channels) obtained in both audience-plane and overhead outputs;

(b) providing the four or more output signals from the previous step to transducers with position designations including at least three audience-plane positions and at least one overhead position.

4. The process of claim 3, further including the step of:

(c) causing the relative amplitudes and/or phases of the transmission-channel signals applied to at least some of the outputs of said 3-dimensional decoder to be dynamically modified to enhance said dominance in response to dominant direction information derived from said transmission-channel signals so that the amplitude of outputs least angularly displaced from a sensed dominant direction are relatively increased or minimally decreased, and the amplitudes of at least some outputs more displaced from said dominant direction are relatively decreased.

* * * * *

UNITED STATES PATENT AND TRADEMARK OFFICE
CERTIFICATE OF CORRECTION

PATENT NO : 5,857,026

DATED : January 5, 1999

INVENTOR(S) : Peter Scheiber

It is certified that error appears in the above-identified patent and that said Letters Patent is hereby corrected as shown below:

In column 3, line 63, please change "(e)" to --(f)--.

Signed and Sealed this

Seventh Day of September, 1999

*Attest:*

Q. TODD DICKINSON

*Attesting Officer*

*Acting Commissioner of Patents and Trademarks*